US010570702B2

(12) United States Patent
Rubio et al.

(10) Patent No.: US 10,570,702 B2
(45) Date of Patent: Feb. 25, 2020

(54) SEAL FLOW AND PRESSURE CONTROL

(71) Applicant: Schlumberger Technology Corporation, Sugar Land, TX (US)

(72) Inventors: Vianney Rubio, Sugar Land, TX (US); Andrew Parry, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 29 days.

(21) Appl. No.: 15/767,665

(22) PCT Filed: Oct. 10, 2016

(86) PCT No.: PCT/EP2016/001675

§ 371 (c)(1),
(2) Date: Apr. 12, 2018

(87) PCT Pub. No.: WO2017/063734

PCT Pub. Date: Apr. 20, 2017

(65) Prior Publication Data

US 2018/0306008 A1 Oct. 25, 2018

(30) Foreign Application Priority Data

Oct. 16, 2015 (EP) ..... 15290261

(51) Int. Cl.
*E21B 41/00* (2006.01)
*E21B 47/18* (2012.01)

(52) U.S. Cl.
CPC ..... *E21B 41/0085* (2013.01); *E21B 47/18* (2013.01)

(58) Field of Classification Search
CPC ..... E21B 41/0085; E21B 47/18
See application file for complete search history.

(56) References Cited

U.S. PATENT DOCUMENTS

| | | | | |
|---|---|---|---|---|
| 4,956,823 | A | 9/1990 | Russell et al. | |
| 5,517,464 | A | 5/1996 | Lerner et al. | |
| 6,763,899 | B1 * | 7/2004 | Ossia | E21B 4/02 175/100 |
| 2005/0200210 | A1 | 9/2005 | Kotsonis et al. | |

OTHER PUBLICATIONS

International Search Report and Written Opinion issued in International Patent application PCT/EP2016/001675, dated Nov. 7, 2016. 11 pages.
Search Report Rule 62 EPC issued in Euproean Patent application 15290261.5 dated Apr. 8, 2016. 8 pages.

* cited by examiner

*Primary Examiner* — Kristyn A Hall

(57) ABSTRACT

Apparatus and methods for decreasing pressure of drilling fluid within a region between an impeller and a housing of a power generation module (PGM). The apparatus comprises a shaft extending from and rotatable relative to the housing; The impeller is coupled with the shaft external to the housing and includes a group of blades that rotate the impeller as the drilling fluid flows past the PGM. The impeller further includes another group of blades that decrease the pressure of the drilling fluid within the region between the impeller and the housing when the impeller is rotating.

13 Claims, 4 Drawing Sheets

SEAL FLOW AND PRESSURE CONTROL

BACKGROUND OF THE DISCLOSURE

Wells are generally drilled into the ground or ocean bed to recover natural deposits of oil and gas, as well as other desirable materials that are trapped in geological formations in the Earth's crust. Such wells are drilled using a drill bit attached to the lower end of a drill string. Drilling fluid ("mud") is pumped from the wellsite surface down through the drill string to the drill bit. The drilling fluid lubricates and cools the bit, and may additionally carry drill cuttings from the wellbore back to the surface.

Well drilling techniques may utilize mud-pulse telemetry to communicate information between surface equipment and the bottom-hole assembly (BHA) and/or other downhole components of the drill string. For example, mud-pulse telemetry may be utilized to transmit commands and other information from surface equipment to a measurement-while-drilling (MWD) tool of the BHA. The MWD tool may include various sensors utilized to acquire data related to a subterranean formation, which may then be transmitted to the surface equipment via mud-pulse telemetry. Mud-pulse telemetry transmits information between the surface equipment and the BHA in the form of modulated pressure pulses that propagate through the drilling fluid circulated down through the drill string and BHA and back up to the surface through the annulus between the drill string and the wellbore.

The BHA includes various components that utilize electrical power. The electrical power may be generated downhole by a power generation module comprising a housing, an electrical generator within the housing, an impeller external to the housing, and a shaft extending through the housing between the impeller and the generator. Drilling fluid pumped through the drill string imparts rotation to the impeller, thus driving the electrical generator. However, the mud-pulse telemetry pressure pulses may cause pressure spikes that momentarily amplify the pressure differential across a fluid seal disposed between the shaft and the housing, thus permitting the drilling fluid to slowly leak into the housing through the seal. Such leakage may compromise the seal, hydraulic fluid within the housing, the electrical generator, and/or various other mechanical and/or electrical components within the housing.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a power generation module (PGM) for use in a downhole tool, such as a measurement-while-drilling (MWD) tool. The PGM includes a housing, a shaft extending from and rotatable relative to the housing, and an impeller coupled with the shaft external to the housing. The impeller includes first blades that rotate the impeller as drilling fluid flows past the PGM. The impeller also includes second blades positioned to decrease pressure of drilling fluid within a region between the impeller and the housing when the impeller is rotating.

The present disclosure also introduces a method that includes conveying a bottom-hole-assembly (BHA) within a wellbore extending into a subterranean formation. The BHA includes a PGM disposed within a drill collar of the BHA. The PGM includes a housing, a generator disposed within the housing, a shaft operatively connected with the generator and extending from the housing through a face seal, and an impeller coupled with the shaft and comprising first blades that rotate the impeller as drilling fluid flows past the PGM. The method also includes pumping drilling fluid through the drill collar, thereby rotating the impeller, and thus the shaft, thereby causing the generator to generate electrical energy. The impeller also includes second blades that decrease pressure of drilling fluid within a region between the impeller and the housing when the impeller is rotating.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
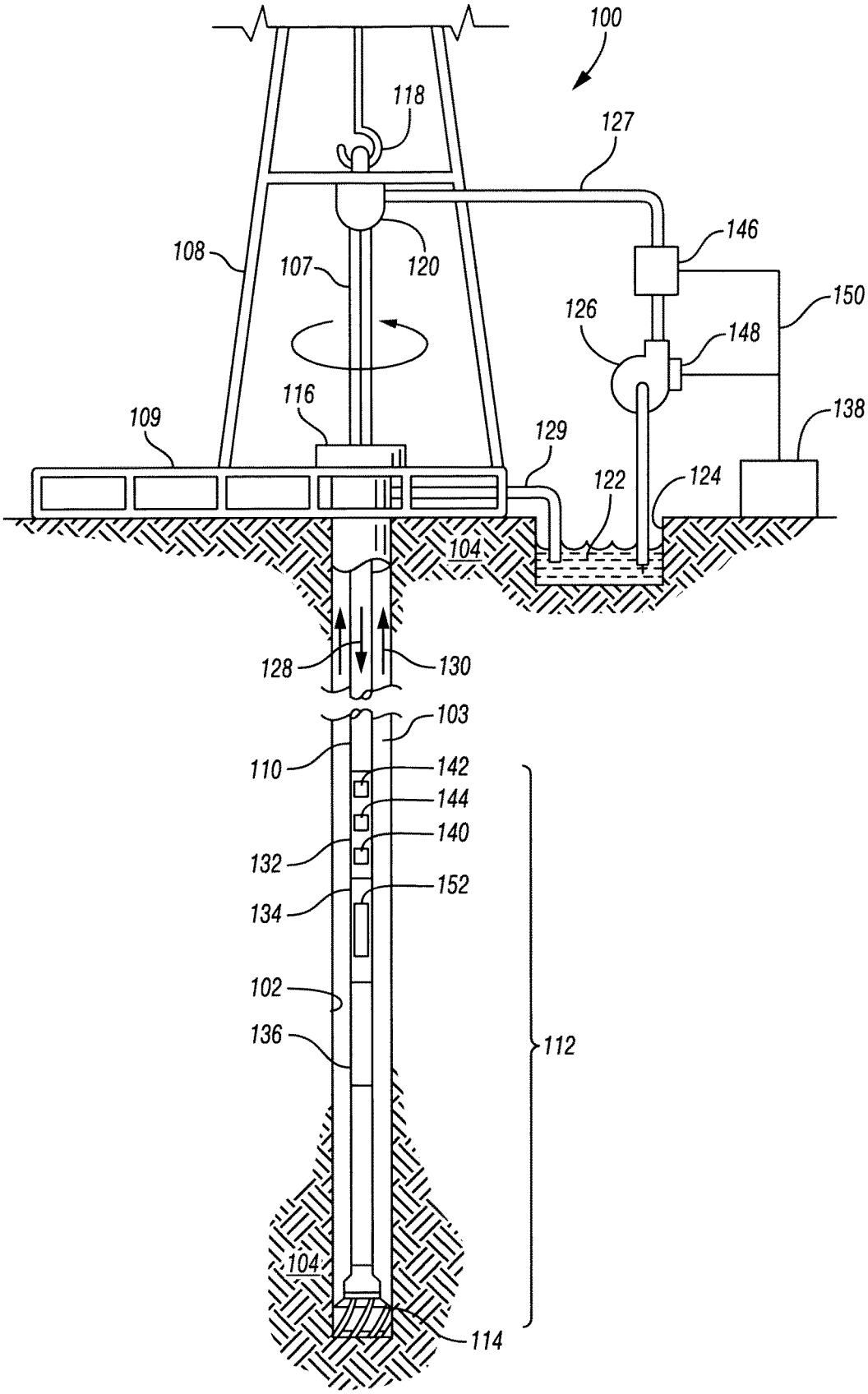
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example implementation of a wellsite system 100 according to one or more aspects of the present disclosure. The wellsite system 100 depicted in FIG. 1 represents an example environment in which one or more aspects described below may be implemented. It is also noted that although the wellsite system 100 is depicted in FIG. 1 as an onshore implementation, it is understood that the aspects described below are also generally applicable to offshore implementations.

The wellsite system 100 is depicted in FIG. 1 in relation to a wellbore 102 formed in a subterranean formation 104 by rotary and/or directional drilling. The wellsite system 100 includes a platform, rig, derrick, and/or other wellsite structure 108 positioned over the wellbore 102. A BHA 112 is suspended from the wellsite structure 108 within the wellbore 102 via conveyance means 110. The conveyance means 110 may comprise drill pipe, wired drill pipe (WDP), tough logging condition (TLC) pipe, coiled tubing, and/or other means of conveying the BHA 112 within the wellbore 102.

The BHA 112 may include or be coupled to a drill bit 114 at its lower end. Rotation of the drill bit 114 advances the BHA 112 into the formation 104 to form the wellbore 102. For example, a kelly 107 connected to the upper end of the conveyance means 110 may be rotated by a rotary table 116 on the rig floor 109. The kelly 107, and thus the conveyance means 110, may be suspended from the wellsite structure 108 via a hook 118 and swivel 120 in a manner permitting rotation of the kelly 107 and the conveyance means 110 relative to the hook 118. However, a top drive (not shown) may be utilized instead of or in addition to the kelly 107 and rotary table 116 arrangement.

The wellsite system 100 also comprises a pit, tank, and/or other surface container 124 containing drilling fluid 122. A pump 126 delivers the drilling fluid 122 to the interior of the conveyance means 110, such as via a fluid delivery conduit 127 extending between the pump 126 and the swivel 120, internal flow passages (not shown) of the swivel 120, and the interior of the kelly 107, thus inducing the drilling fluid 122 to flow downhole through the conveyance means 110, as indicated by directional arrow 128. The drilling fluid 122 exits ports (not shown) in the drill bit 114 and then circulates uphole through an annulus 103 defined between the outside of the conveyance means 110 and the wall of the wellbore 102, as indicated by direction arrows 130. In this manner, the drilling fluid 122 lubricates the drill bit 114 and carries formation cuttings up to the surface, where the drilling fluid 122 is returned to the surface container 124 via a fluid return line 129 for recirculation.

Additional surface equipment 138 includes a controller and/or other processing system for controlling the BHA 112 and perhaps other portions of the wellsite system 100. The surface equipment 138 also includes interfaces for receiving commands from a human operator and communicating with the BHA 112 via mud-pulse telemetry. The surface equipment 138 also stores executable programs and/or instructions, including for implementing one or more aspects of the methods described herein.

The BHA 112 includes various numbers and/or types of downhole tools 132, 134, 136. One or more of the downhole tools 132, 134, 136 may be or comprise an acoustic tool, a density tool, a directional drilling tool, an electromagnetic (EM) tool, a sampling while drilling (SWD) tool, a formation testing tool, a formation sampling tool, a gravity tool, a monitoring tool, a neutron tool, a nuclear tool, a photoelectric factor tool, a porosity tool, a reservoir characterization tool, a resistivity tool, a seismic tool, a surveying tool, and/or a tough logging condition (TLC) tool, although other downhole tools are also within the scope of the present disclosure. One or more of the downhole tools 132, 134, 136 may also be implemented as an MWD or logging-while-drilling (LWD) tool for the acquisition and/or transmission of downhole data to the surface equipment 138.

For example, the downhole tool 132 may be or comprise an MWD or LWD tool comprising a sensor package 140 operable for the acquisition of measurement data pertaining to the BHA 112, the wellbore 102, and/or the formation 130. The downhole tool 132 and/or another portion of the BHA 112 may also comprise a telemetry device 142 operable for communication with the surface equipment 138, such as via mud-pulse telemetry. The downhole tool 132 and/or another portion of the BHA 112 may also comprise a downhole control system 144 operable to receive, process, and/or store information received from the sensor package 140 and/or other portions of the BHA 112. The downhole control system 144 may be or comprise a controller and/or other processing system operable to control the sensor package 140, the telemetry device 142, and/or other portions of the BHA 112. The downhole control system 144 may also store executable programs and/or instructions, including for implementing one or more aspects of the methods described herein.

Mud-pulse telemetry between the surface equipment 138 and the BHA 112 (e.g., the downhole control system 144) may be via pressure pulses sent through the drilling fluid 122 flowing within the conveyance means 110. For example, the telemetry device 142 may be or comprise a modulator operable to selectively block passage of the drilling fluid 122 flowing through the conveyance means 110, thereby selectively causing pressure changes in the drilling fluid within the conveyance means 110 and, therefore, the fluid delivery line 127. During operations, the telemetry device 142 may modulate the pressure of the drilling fluid 122 within the conveyance means 110 and the fluid delivery line 127 to transmit data received from the downhole control system 144, the sensor package 140, and/or other portions of the BHA 112 to the surface equipment 138. The modulated pressure changes (i.e., pressure pulses) travel uphole through the drilling fluid 122 within the conveyance means 110 and the fluid delivery line 127, and are detected by a pressure transducer and/or other pressure sensor 146.

The pressure sensor 146 and a pump sensor 148 are connected to the surface equipment 138 via wired or wireless communication means 150. The pump sensor 148 is operable to detect piston position and/or other operational parameters of the pump 126. The surface equipment 138 is operable to interpret the pressure information from the pressure sensor 146, synchronized with the operational information from the pump sensor 148, to reconstruct the uplink mud-pulse telemetry data transmitted by the downhole telemetry device 142.

The surface equipment 138 is also operable to control downlink mud-pulse telemetry. For example, the surface equipment 138 may control the pump 126 and/or a surface telemetry device (not shown) to transmit mud-pulse telemetry information downhole, also via the drilling fluid 122 within the conveyance means 110, for detection by a downhole pressure transducer and/or other pressure sensor of the telemetry device 142 and/or other portion of the BHA 112.

One or more of the downhole tools 132, 134, 136 may be or comprise a power generation module (PGM) 152 for generating electrical power to be utilized by one or more components of the BHA 112. In the example implementation depicted in FIG. 1, for example, the downhole tool 134 is or comprises a PGM 152 disposed axially within a section, joint, collar, and/or other tubular member of the BHA 112. The PGM 152 comprises an electrical generator (i.e., an alternator) powered by the flow of the drilling fluid 122 through the downhole tool 134 past the PGM 152. During drilling, MWD, and/or LWD operations, the flow of the drilling fluid 122 past the PGM 152 drives the PGM 152 to provide electrical power to the downhole tools 132, 134, 136 and/or other portions of the BHA 112. Although the PGM 152 has been described as being utilized in association with an MWD tool, an LWD tool, and mud pulse telemetry, it is to be understood that the PGM 152 may also be utilized in association with other downhole tools, such as a rotary steerable tool, including implementations in which an impeller of the PGM 152 drives the drill bit 114.

Figure 2:
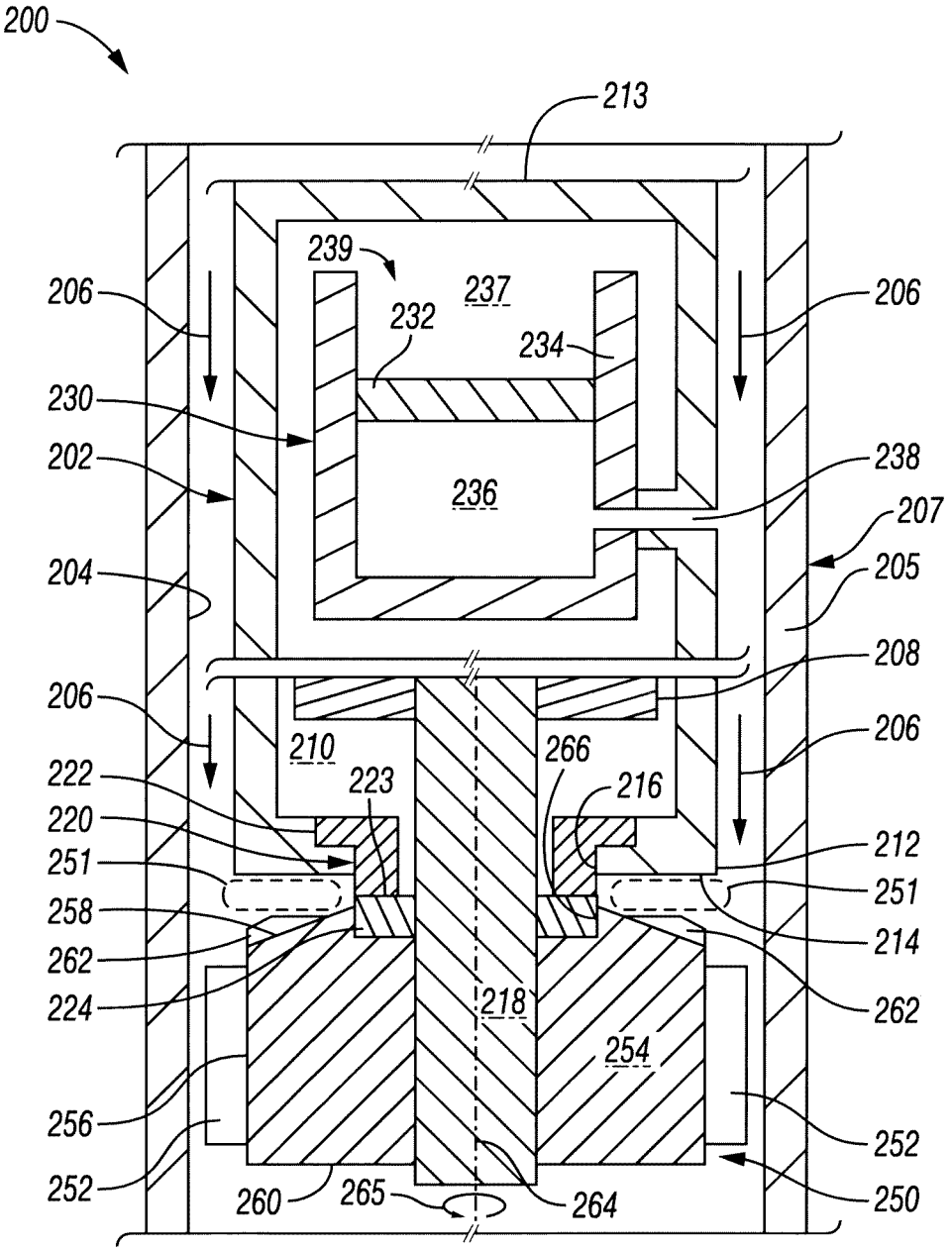
FIG. 2 is a schematic sectional view of an example implementation of a portion of the apparatus shown in FIG. 1 according to one or more aspects of the present disclosure.
Figure 3:
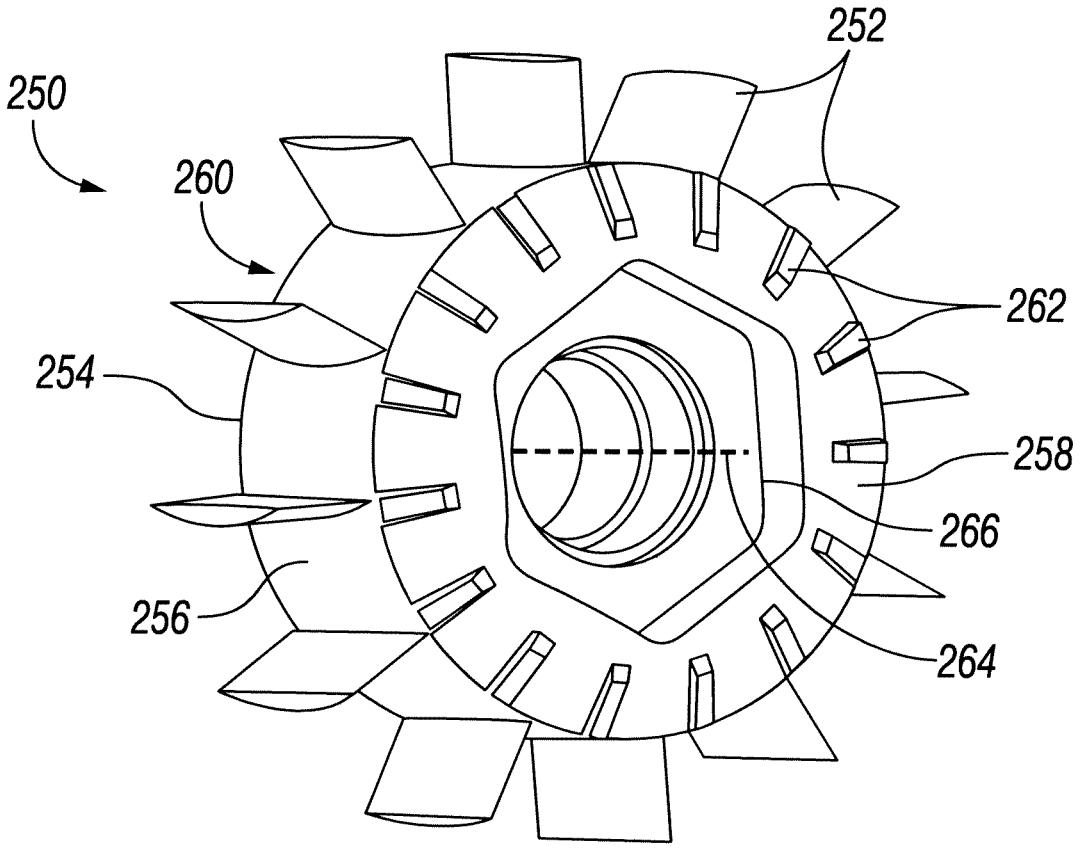
FIG. 3 is a perspective view of a portion of the apparatus shown in FIG. 2 according to one or more aspects of the present disclosure.

FIG. 2 is a schematic sectional view of a portion of an example implementation of the downhole tool 134 and the PGM 152 shown in FIG. 1, designated in FIG. 2 by reference numerals 200, 202, respectively, according to one or more aspects of the present disclosure. The PGM 202 includes an impeller 250, a perspective view of which is shown in FIG. 3. The following description refers to FIGS. 1-3, collectively.

The PGM 202 is disposed axially within a longitudinal bore 204 defined by a wall 205 of a drill collar and/or other tubular member 207 of the downhole tool 200. The axial bore 204 conveys drilling fluid through the downhole tool 200 along and past the PGM 202, as indicated by directional arrows 206. The PGM 202 comprises a housing 212 having an internal volume 210. The housing 212 may be generally cylindrical and/or otherwise elongated, having an uphole end 213 and a downhole end 214. An electrical generator 208 is disposed within the internal volume 210 of the housing 212. A rotatable shaft 218 operably coupled with the electrical generator 208 extends from the housing 212 through a fluid seal 220 at least partially disposed within an opening 216 in the downhole end 214 of the housing 212.

The fluid seal 220 fluidly isolates the internal volume 210 from the drilling fluid located within the bore 204 external to the PGM 202. The fluid seal 220 may be a rotary face seal, which may also be known in the art as a mechanical face seal. For example, the fluid seal 220 may comprise a stationary portion 222 and a rotatable portion 224. The stationary portion 222 is fixedly disposed within the opening 216 and/or otherwise connected with the housing 212. The rotatable portion 224 is connected to and rotatable with the shaft 218 external to the housing 212. The stationary portion 222 and the rotatable portion 224 create a face seal and/or otherwise sealingly contact along a contact surface 223. One or more seal rings, O-rings, and/or other sealing elements (not shown) may also be disposed along the contact surface 223 between the stationary portion 222 and the rotatable portion 224. Although FIG. 2 depicts the fluid seal 220 as a rotary face seal, the fluid seal 220 may also or instead be a dry gas seal, a labyrinth seal, a radial shaft seal, a stuffing box, a gland seal, and/or other seals by which the shaft 218 may extend from the housing 212 through the opening 216 while limiting or preventing drilling fluid from leaking into the internal volume 210.

The internal volume 210 may contain gel, oil, lubricating fluid, or another hydraulic fluid (not shown), which surrounds the electrical generator 208 to reduce or eliminate voids within the internal volume 210. Such voids, if not filled; may induce stress within the internal volume 210 due to, for example, a pressure differential that may exist between the internal volume 210 and the bore 204. The hydraulic fluid may provide lubrication to mechanical components of the electrical generator 208, the fluid seal 220, and/or other components of the PGM 202. The hydraulic fluid may be turbine oil 560, although examples are also within the scope of the present disclosure.

The pressure of the hydraulic fluid within the internal volume 210 may be pressure-compensated or otherwise equalized with respect to the pressure of the drilling fluid within the bore 204. For example, the PGM 202 may also comprise a pressure compensation apparatus 230 comprising a piston 232 slidably disposed within a cylinder 234 to define an adjustable volume 236 fluidly isolated from the internal volume 210. The adjustable volume 236 is fluidly connected with the bore 204 via a fluid conduit 238. An open end 239 of the cylinder 234 is open to the internal volume 210. Consequently, changes in the pressure of drilling fluid within the bore 204, and thus the drilling fluid within the adjustable volume 236, will move the piston 232 within the cylinder 234 until the pressure within the adjustable volume 236 and the pressure within the internal volume 210 of the housing equalize. Furthermore, if the quantity of hydraulic fluid within the internal volume 210 decreases, such as because of leakage to the bore 204 through the fluid seal 220, additional drilling fluid may enter the adjustable volume 236 from the bore 204, thus compensating for the hydraulic fluid escaping the internal volume 210.

However, pressure compensation means other than the example implementation of the pressure compensation apparatus 230 depicted in FIG. 2 are also within the scope of the present disclosure. For example, the PGM 202 may also or instead comprise an expandable bladder disposed within the internal volume 210 and comprising an adjustable volume fluidly connected with the drilling fluid in the bore 204.

The impeller 250 is fixedly connected to the shaft 218, such as by corresponding threads, set screws, retaining rings, interlocking splines, adhesive, interference/press fit, and/or other means operable to lock the shaft 218 and the impeller 250 together and/or prevent their relative rotation. The impeller 250 comprises a plurality of first blades 252 that interact with the drilling fluid flowing along the bore 204, such that the drilling fluid flow imparts rotation to the impeller 250 around a rotational axis 264, as indicated by rotational arrow 265. Such rotation is imparted to the electrical generator 208 via the shaft 218, thus generating electricity for utilization by one or more of the tools 132, 134, 136 and/or other portions of the BHA 112.

However, the fluid seal 220 may experience leakage during operations, thus permitting drilling fluid to ingress into the internal volume 210 of the PGM 202. For example, the fluid seal 220 may experience leakage due to a pressure differential between the internal volume 210 and the bore 204. That is, although the hydraulic fluid within the internal volume 210 may be pressure compensated relative to the fluid pressure in the bore 204, such that the pressure pulses propagating within the bore 204 may also propagate into the internal volume 210 via the pressure compensation apparatus 230 and/or other pressure compensation means of the PGM 202, the pressure pulses experienced within the internal volume 210 may not be precisely synchronized with the pressure pulses in the bore 204, whether due to differences in propagation paths, pressure pulse amplitudes, innate lag of the pressure compensation means, and/or other causes. Consequently, a pressure differential may momentarily exist across the fluid seal 220. Although such pressure differential may be relatively small compared to absolute pressure on either side of the fluid seal 220 (whether within the internal volume 210 or within the bore 204), the pressure differential may cause the drilling fluid in the bore 204 to leak past the fluid seal 220 and into the internal volume 210.

Such leakage may pollute the hydraulic fluid within the internal volume 210, which may damage and/or otherwise adversely affect operation of the electrical generator 208 and/or other components disposed within the housing 212, perhaps leading to early failures of such components. Such leakage and/or pollution may also damage and/or otherwise adversely affect the sealing and/or rotation ability of the fluid seal 220, such as by the accumulation of contaminants between the stationary portion 222 and the rotatable portion 224.

The leakage of drilling fluid into and/or through the fluid seal 220 may be reduced or eliminated by decreasing the pressure of the drilling fluid in a region 251 extending circumferentially around at least a portion of the fluid seal 220 between the impeller 250 and the bottom end 214 of the housing 212. For example, the impeller 250 may comprise a plurality of second blades 262 that, when the impeller 250 is rotating, decrease the pressure of the drilling fluid within the region 251.

That is, a body 254 of the impeller 250 may have a substantially cylindrical outer surface 256 and first and second faces or surfaces 258, 260 on opposing ends of the body 254. The first surface 258 may extend diagonally with respect to the axis of rotation 264 of the shaft 218, and may at least partially define the region 251. The first surface 258 may be substantially frustoconical and/or otherwise taper away from the housing 212. The first blades 252 may be distributed around and extend radially from the outer surface 256 of the body 254. The second blades 262 are distributed around the first surface 258 of the body 254, extending radially along the first surface 258 with respect to the axis of rotation 264, and protruding axially from the first surface 258 toward the housing 212. The second blades 262 are depicted in the example implementation shown in FIGS. 2 and 3 as having a substantially trapezoidal cross-sectional geometry, although other shapes are also within the scope of the present disclosure. The second blades 262 may each be substantially smaller than each of the first blades 252. Each of the first and second blades 252, 262 are separate and distinct members not directly connected with each other.

The impeller 250 may also comprise a central cavity or recess 266 extending into the first surface 258. At least a portion of the rotatable portion 224 of the fluid seal 220 may be received within the recess 266. Although the impeller 250 is shown comprising the recess 266, it is to be understood that the impeller 250 may be provided without the recess 266. Accordingly, such impeller 250 may be disposed adjacent the fluid seal 220, such that the first surface 258 is located below or facing the rotatable portion 224 of the fluid seal 220.

The region 251 may generally surround the sealing area 223 between the stationary and rotatable portions 222, 224 of the fluid seal 220. Accordingly, when the impeller 250 rotates, the second blades 262 may act on the drilling fluid in the region 251 to cause a decrease of the static pressure within the region 251 and, thus, around the sealing area 223. The decrease in pressure may cancel out or reduce the above-described momentary pressure differentials between the hydraulic fluid within the internal volume 210 and the drilling fluid within the bore 204, which may aid in reducing the leakage of drilling fluid into the fluid seal 220 and the internal volume 210. For example, rotation of the second blades 262 may act on the drilling fluid within the region 251 to increase the rate of circumferential fluid flow around the fluid seal 220. According to Bernoulli's principle of fluid dynamics, the increased fluid flow rate experiences a decreased fluid pressure. The second blades 262 may also or instead act on the drilling fluid within the region 251 to urge, pump, or otherwise move the drilling fluid radially outwards away from the region 251 and the fluid seal 220, due to centrifugal forces. Such radially outward movement of the drilling fluid away from the fluid seal 220 may also urge or expel contaminants or debris suspended within the drilling fluid away from the fluid seal 220, and/or otherwise inhibit the accumulation of contaminants within the region 251. The radially outward movement of the drilling fluid away from the fluid seal 220 may also increase the transfer of heat away from the fluid seal 220, such as in implementations in which friction between the stationary and rotatable portions 222, 224 generates heat, and/or otherwise operate to reduce the temperature of the fluid seal 220 and/or other components proximate the region 251.

It is to be understood that impellers 250 having other geometries or configurations are also included within the scope of the present disclosure. For example, the first and second blades 252, 262 are not limited to the geometry or configuration described above and shown in FIGS. 2 and 3. Furthermore, the first surface 258 of the impeller 250 may be or comprise a geometry that is not frustoconical. For example, the first surface 258 may be or comprise a flat surface extending substantially perpendicularly with respect to the axis of rotation 264.

Other implementations of apparatus may be included within the scope of the present disclosure. For example, the geometry of the impeller 250, such as the first and second blades 252, 262 or the surfaces defining the region 251, are not limited to the example implementations described herein. Furthermore, the design of the PGM 152 may also be different. For example, the PGM 152 may include the hydraulic fluid contained within a sealed compartment located outside of the drilling fluid circulating through the bore 204. Other variants or combinations are also within the scope of the present disclosure.

Figure 4:
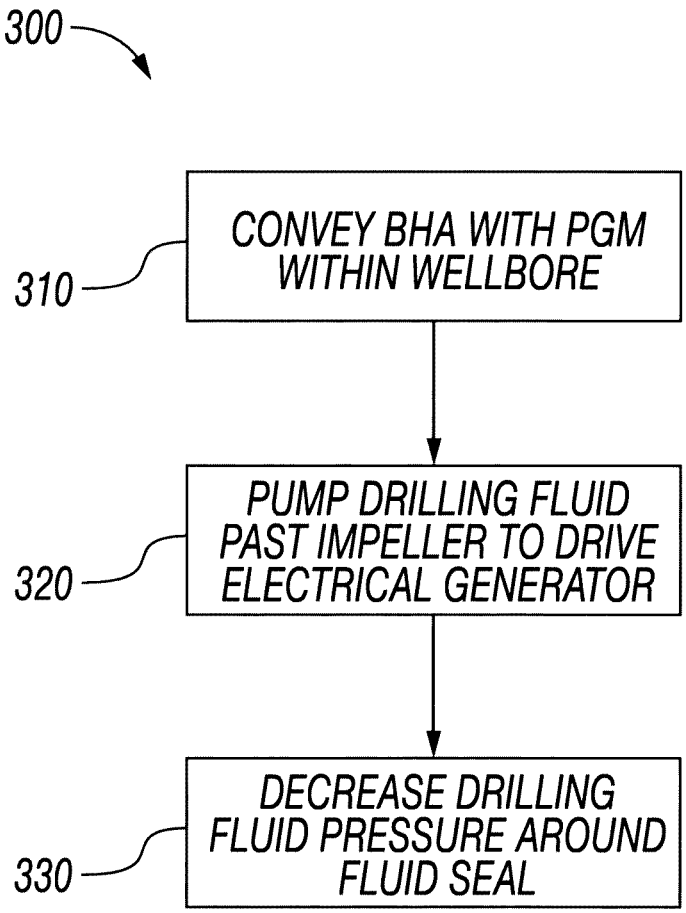
FIG. 4 is a flow-chart diagram of at least a portion of an example implementation of a method according to one or more aspects of the present disclosure.

FIG. 4 is a flow-chart diagram of at least a portion of an example implementation of a method (300) according to one or more aspects of the present disclosure. The method (300) may be performed utilizing at least a portion of one or more implementations of the apparatus shown in one or more of FIGS. 1-3 and/or otherwise within the scope of the present disclosure. However, and although merely for the sake of example, the method (300) is described below in reference to the example implementation of the BHA 112 shown in FIG. 1 and the example implementation of the PGM 202 shown in FIG. 2, including the example implementation of the impeller 250 shown in FIG. 3. Thus, the following description refers to FIGS. 1-4, collectively. However, it is understood that one or more aspects of the method (300) are also applicable or readily adaptable for utilization with other BHAs, PGMs, and impellers also within the scope of the present disclosure.

The method (300) comprises conveying (310) the BHA 112 within the wellbore 102. Drilling fluid is then pumped (320) through the drill collar or other tubular member of the BHA 112 in which the PGM 202 is disposed. Such pumping (320) directs the drilling fluid past the PGM 202, thereby rotating the impeller 250, and thus the shaft 218, thereby causing the electrical generator 208 to generate electrical energy. The method (300) is further characterized in that the impeller 250 comprises the second blades 258, such that the rotation of the impeller 250 also decreases (330) the pressure of the drilling fluid within the region 251 around the fluid seal 220, between the impeller 250 and the housing 212 of the PGM 202.

As described above, the decrease (330) in pressure of drilling fluid within the region 251 is relative to the pressure of the drilling fluid otherwise surrounding the housing 212. For example, the rotation of the second blades 258 may urge drilling fluid flow away from the region 251.

In view of the entirety of the present disclosure, including the figures and the claims, a person having ordinary skill in the art should readily recognize that the present disclosure introduces a power generation module (PGM) for use in a downhole tool, such as a measurement-while-drilling (MWD) tool, wherein the PGM comprises: a housing; a shaft extending from and rotatable relative to the housing; and an impeller coupled with the shaft external to the housing and comprising a plurality of first blades that rotate the impeller as drilling fluid flows past the PGM; characterized in that the impeller further comprises a plurality of second blades positioned to decrease pressure of drilling fluid within a region between the impeller and the housing when the impeller is rotating. The housing may contain hydraulic fluid and is pressure-compensated with respect to the drilling fluid flow past the PGM.

In one or more implementations within the scope of the present disclosure, the shaft may extend from the housing through a face seal comprising: a stationary portion coupled with the housing; and a rotatable portion coupled with the shaft external to the housing. In such implementations, among others within the scope of the present disclosure, the impeller may further comprise a body coupled with the shaft, the plurality of first blades may each extend radially from the body, the plurality of second blades may each extend axially from a surface of the body that partially defines the region, and the rotating portion of the face seal may be at least partially disposed within a recess extending into the surface.

In one or more implementations within the scope of the present disclosure, the impeller may comprise a body coupled with the shaft, the plurality of first blades may each extend radially from the body, the plurality of second blades may each extend axially from a surface of the body that partially defines the region, and the surface may be tapered away from the housing. In such implementations, among others within the scope of the present disclosure, the surface may be substantially frustoconical.

In one or more implementations within the scope of the present disclosure, the impeller may comprise a body coupled with the shaft, the plurality of first blades may each extend radially from the body, and the plurality of second blades may each extend axially from the body toward the housing.

In one or more implementations within the scope of the present disclosure, the impeller may comprise a body coupled with the shaft, the plurality of first blades may each extend radially from the body, the plurality of second blades may each extend axially from a surface of the body that partially defines the region, and the plurality of second blades may each extend radially along the surface.

Each of the plurality of second blades may be substantially smaller than each of the plurality of first blades.

The plurality of second blades may urge the drilling fluid away from the region when the impeller is rotating.

The PGM may further comprise a generator disposed within the housing, wherein the shaft may be operatively connected with the generator such that rotation of the impeller, and thus the shaft, may cause the generator to generate electrical energy.

The present disclosure also introduces a method comprising: conveying a bottom-hole-assembly (BHA) within a wellbore extending into a subterranean formation, wherein the BHA comprises a power generation module (PGM) disposed within a drill collar of the BHA, and wherein the PGM comprises: a housing; a generator disposed within the housing; a shaft operatively connected with the generator and extending from the housing through a face seal; and an impeller coupled with the shaft and comprising a plurality of first blades that rotate the impeller as drilling fluid flows past the PGM; and pumping drilling fluid through the drill collar, thereby rotating the impeller, and thus the shaft, thereby causing the generator to generate electrical energy; characterized in that the impeller further comprises a plurality of second blades that decrease pressure of drilling fluid within a region between the impeller and the housing when the impeller is rotating.

In one or more implementations within the scope of the present disclosure, the impeller may comprise a body coupled with the shaft, the plurality of first blades may each extend radially from the body, and the plurality of second blades may each extend axially from the body toward the housing.

The decrease in pressure of drilling fluid within the region may be relative to pressure of the drilling fluid otherwise surrounding the housing.

Rotation of the plurality of second blades with the impeller may urge drilling fluid flow away from the region.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. A power generation module (PGM) for use in a downhole tool, wherein the PGM comprises:

a housing;

a shaft extending from and rotatable relative to the housing; and an impeller coupled with the shaft external to the housing and comprising a plurality of first blades that rotate the impeller as drilling fluid flows past the PGM;

wherein the impeller further comprises a plurality of second blades positioned to decrease pressure of drilling fluid within a region between the impeller and the housing when the impeller is rotating, wherein the shaft extends from the housing through a face seal comprising:

a stationary portion coupled with the housing; and a rotatable portion coupled with the shaft external to the housing, wherein the impeller further comprises a body coupled with the shaft;

the plurality of first blades each extend radially from the body;

the plurality of second blades each extend axially from a surface of the body that partially defines the region; and the rotating portion of the face seal is at least partially disposed within a recess extending into the surface.

2. The PGM of claim 1 wherein the housing contains hydraulic fluid and is pressure-compensated with respect to the drilling fluid flow past the PGM.

3. The PGM of claim 1, wherein:

the surface is tapered away from the housing.

4. The PGM of claim 3 wherein the surface is substantially frustoconical.

5. The PGM of claim 1, wherein:

the impeller further comprises a body coupled with the shaft;

the plurality of first blades each extend radially from the body; and the plurality of second blades each extend axially from the body toward the housing.

6. The PGM of claim 1, wherein:

the plurality of second blades each extend radially along the surface.

7. The PGM of claim 1, wherein each of the plurality of second blades is substantially smaller than each of the plurality of first blades.

8. The PGM of claim 1, wherein the plurality of second blades are configured to urge the drilling fluid away from the region when the impeller is rotating.

9. The PGM of claim 1, wherein a generator disposed within the housing, wherein the shaft is operatively connected with the generator such that rotation of the impeller, and thus the shaft, causes the generator to generate electrical energy.

10. The PGM of claim 1 wherein the downhole tool is a measurement-while-drilling (MWD) tool.

11. A method, comprising:

conveying a bottom-hole-assembly (BHA) within a wellbore extending into a subterranean formation, wherein the BHA comprises a power generation module (PGM) disposed within a drill collar of the BHA, and wherein the PGM comprises:

a housing;

a generator disposed within the housing;

a shaft operatively connected with the generator and extending from the housing through a face seal, wherein the shaft extends from the housing through a face seal comprising a stationary portion coupled with the housing and a rotatable portion coupled with the shaft external to the housing; and an impeller coupled with the shaft and comprising a plurality of first blades that rotate the impeller as drilling fluid flows past the PGM, wherein the impeller further comprises a plurality of second blades positioned to decrease pressure of drilling fluid within a region between the impeller and the housing when the impeller is rotating, wherein the impeller further comprises:

a body coupled with the shaft;

the plurality of first blades each extend radially from the body;

the plurality of second blades each extend axially from a surface of the body that partially defines the region; and the rotating portion of the face seal is at least partially disposed within a recess extending into the surface; and pumping drilling fluid through the drill collar, thereby rotating the impeller, and thus the shaft, thereby causing the generator to generate electrical energy;

wherein the impeller further comprises a plurality of second blades that decrease pressure of drilling fluid within a region between the impeller and the housing when the impeller is rotating.

12. The method of claim 11 wherein the decrease in pressure of drilling fluid within the region is relative to pressure of the drilling fluid otherwise surrounding the housing.

13. The method of claim 11 wherein rotation of the plurality of second blades with the impeller urges drilling fluid flow away from the region.

* * * * *